US009028263B2

(12) United States Patent
Kan et al.

(10) Patent No.: US 9,028,263 B2
(45) Date of Patent: May 12, 2015

(54) WATERPROOF STRUCTURE OF COMMUNICATION CONNECTOR

(71) Applicant: Kinsun Industries Inc., Pingjhen (TW)

(72) Inventors: Ching-Neng Kan, Taoyuan County (TW); Chun-Hsiang Chiu, Taoyuan County (TW)

(73) Assignee: Kinsun Industries Inc., Pingjhen (TW)

( * ) Notice: Subject to any disclaimer, the term of this patent is extended or adjusted under 35 U.S.C. 154(b) by 0 days.

(21) Appl. No.: 14/095,097

(22) Filed: Dec. 3, 2013

(65) Prior Publication Data

US 2014/0295699 A1 Oct. 2, 2014

(30) Foreign Application Priority Data

Mar. 26, 2013 (TW) ..... 102205547 U

(51) Int. Cl.
*H01R 13/44* (2006.01)
*H01R 13/52* (2006.01)
*H01R 24/64* (2011.01)

(52) U.S. Cl.
CPC ..... *H01R 13/5219* (2013.01); *H01R 24/64* (2013.01)

(58) Field of Classification Search
CPC ..... H01R 13/447; H01R 13/6395
USPC ..... 439/135, 371, 484, 373, 321
See application file for complete search history.

(56) References Cited

U.S. PATENT DOCUMENTS

| | | | | | |
|---|---|---|---|---|---|
| 5,564,951 | A * | 10/1996 | Attal et al. | ..... | 439/676 |
| 5,683,263 | A * | 11/1997 | Hsu | ..... | 439/319 |
| 5,803,770 | A * | 9/1998 | Swendson et al. | ..... | 439/676 |
| 5,823,811 | A * | 10/1998 | Blanchfield et al. | ..... | 439/274 |
| 6,171,136 | B1 * | 1/2001 | Liu et al. | ..... | 439/466 |
| 6,475,009 | B2 * | 11/2002 | Below et al. | ..... | 439/271 |
| 6,595,791 | B2 * | 7/2003 | Below et al. | ..... | 439/271 |

* cited by examiner

*Primary Examiner* — Phuongchi T Nguyen
(74) *Attorney, Agent, or Firm* — WPAT, PC; Justin King

(57) ABSTRACT

A waterproof structure of communication connector is disclosed, which comprises: a first frame; a first gasket and at least one second frame. The first frame is composed of a first connecting member and a second connecting member that are disposed opposite to each other, in which the first connecting member is configured with a first end in a manner that that it is formed with a first groove surrounding the first end. The first gasket is disposed receiving inside the first groove and is made of a waterproofing material. The second frame has a third connecting member that is formed with an accommodation space, in which the accommodation space is formed with an abutment surface. Moreover, the first connecting member is arranged extending into the second frame and connected to the third connecting member, while enabling the first gasket to be sandwiched between the first end and the abutment surface.

10 Claims, 13 Drawing Sheets

WATERPROOF STRUCTURE OF COMMUNICATION CONNECTOR

FIELD OF THE INVENTION

The present invention relates to a waterproof structure of communication connector, and more particularly, to a waterproof structure adapted to be applied to the periphery of a communication connector.

BACKGROUND OF THE INVENTION

It is known that the communication connector is designed and used mainly for connecting with a communication plug and thereby connecting to a communication cable. Thus, for preventing the communication plug or the communication cable from water damage, it is important to have the communication connector to be specifically designed with waterproof capability.

Please refer to FIG. 1A, FIG. 1B and FIG. 2, which are schematic diagrams showing a conventional communication connector. As shown in FIG. 1A, FIG. 1B and FIG. 2, the conventional communications connector 10 has a first end 11 and a second end 12, in which the second end 12 is configured with a first connecting member 121, a second connecting member 122, and a third connecting member 123. For waterproofing the aforesaid communication connector, the communication must be configured with a waterproof gasket 116 outside its communication socket 115 that is designed to engage and mate perfectly with in a convex ring formed on the first connecting member 121 that is disposed outside a communication plug 124. Nevertheless, the space remained on the conventional communication connector that can be used for other circuit layout is occupied and thus reduced by those waterproof strictures formed on the communication socket 115 and the communication plug 124.

In addition, the first connecting member 11 is formed with only one communication socket 115 at the side thereof facing toward the second connecting member 12, that is, the first connecting member 11 is a one-way single socket structure that can allow the communication plug 124 to inserted therein only in one direction. In some occasions, for connecting to more than one plugs, it is required to have an additional connecting member with additional communication socket to be disposed at another side of the first connecting member 11 opposite to the side thereof formed with the communication socket 115. However, not only such configuration is inconvenient in usage, but also it is difficult to control the inserting direction of the addition communication socket for the additional connecting member.

SUMMARY OF THE INVENTION

In view of the disadvantages of prior art, the primary object of the present invention is to provide a waterproof structure of communication connector, in that the installation direction of the circuitboard for the waterproof structure is orientated different than that for the conventional communication connectors, resulting that not only the connection strength between the waterproof structure and the circuitboard of a communication connector is improved, but also the strength of support to the circuitboard is increased.

To achieve the above object, the present invention provides a waterproof structure of communication connector, comprising:

a first frame, composed of a first connecting member and a second connecting member that are disposed opposite to each other, in which the first connecting member is configured with a first end in a manner that the first end is formed with a first groove surrounding the first end;

a first gasket, made of a waterproofing material while being disposed receiving inside the first groove; and at least one second frame, each having a third connecting member that is formed with an accommodation space, while the accommodation space is further formed with an abutment surface;

wherein, the first connecting member is arranged extending into the accommodation space of the second frame for connecting to the third connecting member, while enabling the first gasket to be sandwiched between the first end and the abutment surface.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1B:
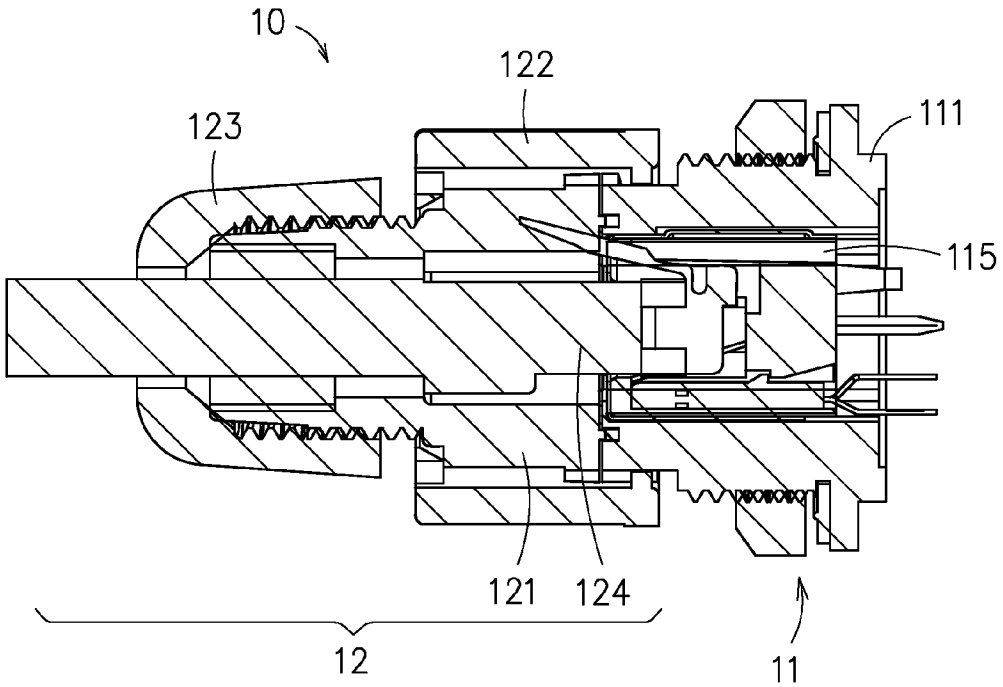
FIG. 1B is an A-A sectional view of the conventional communication connector shown in FIG. 1A.
Figure 1A:
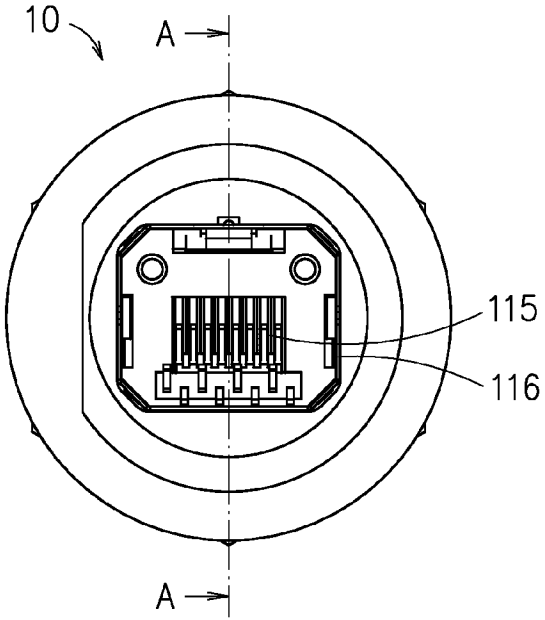
FIG. 1A is a rear view of a conventional communication connector.
Figure 2:
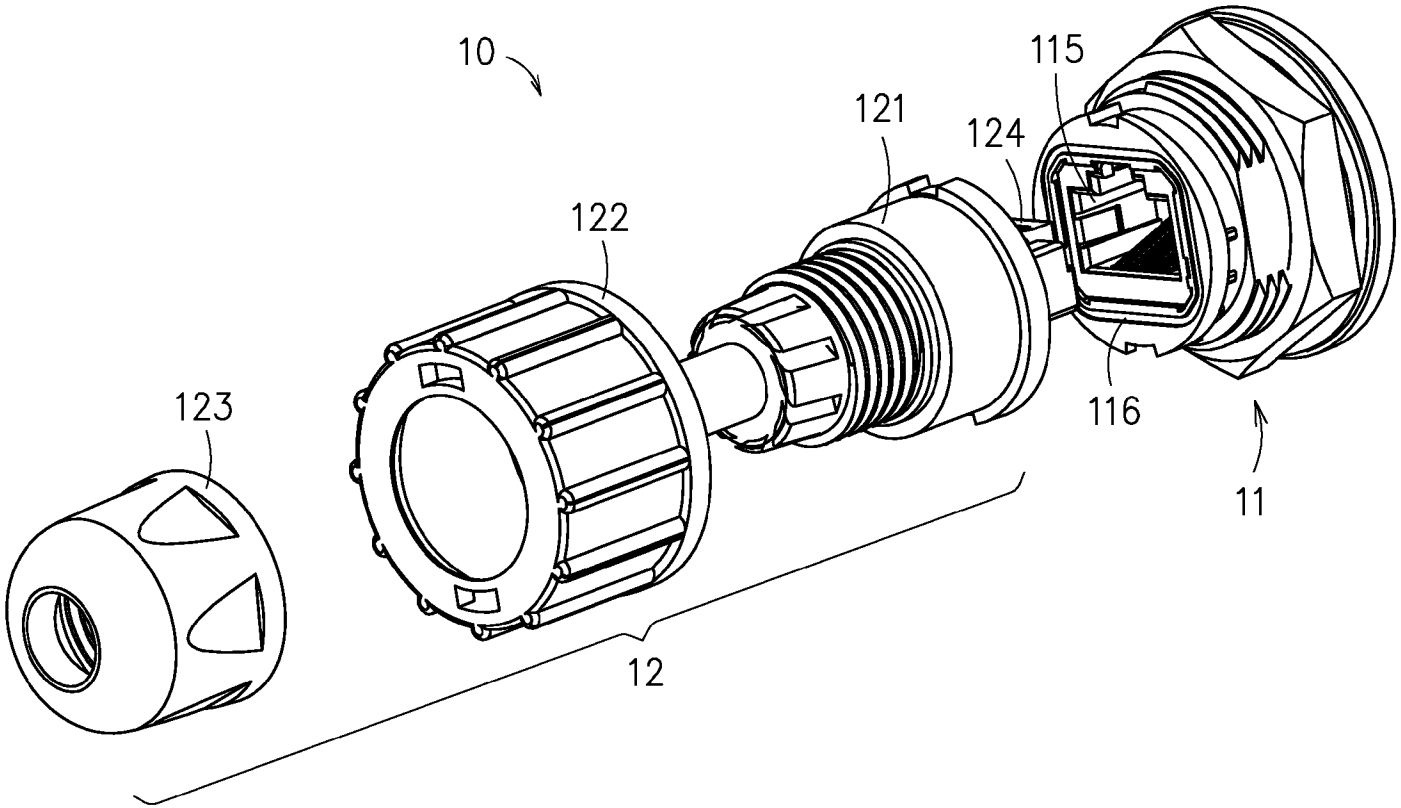
FIG. 2 is an exploded view of the conventional communication connector shown in FIG. 1A.
Figure 3:
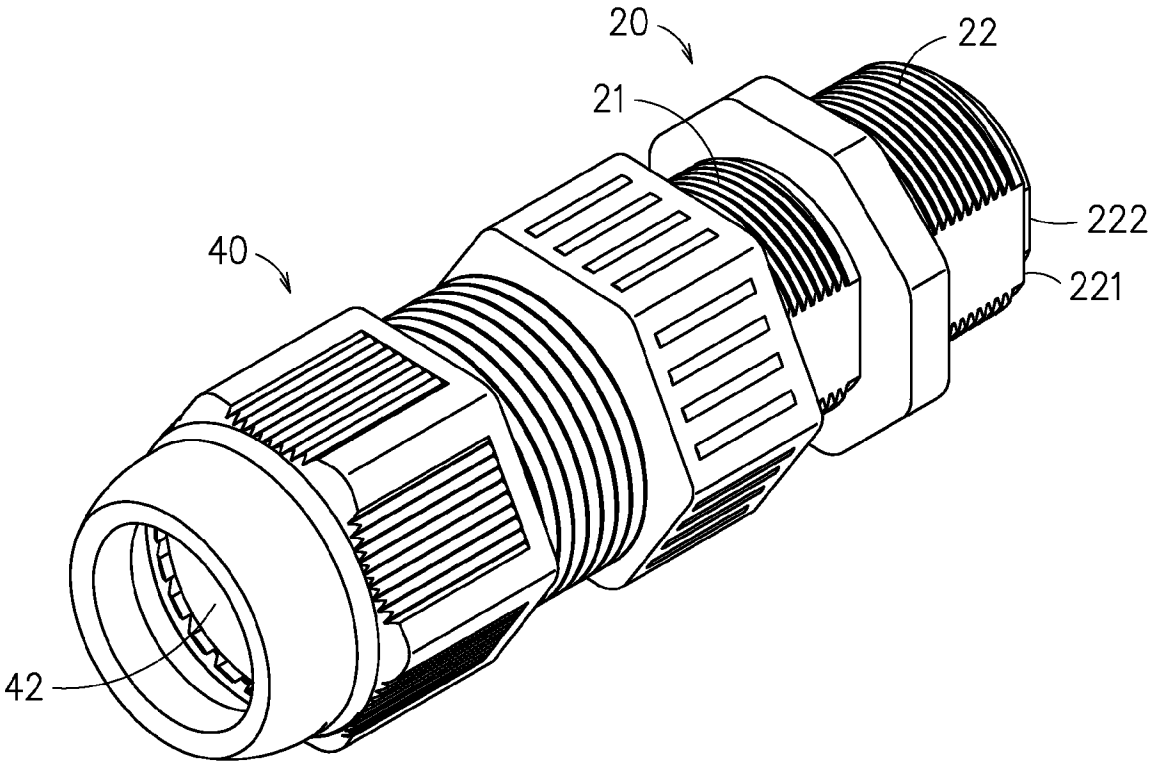
FIG. 3 is a three-dimensional view of a waterproof structure of communication connector according to an embodiment of the invention.
Figure 4:
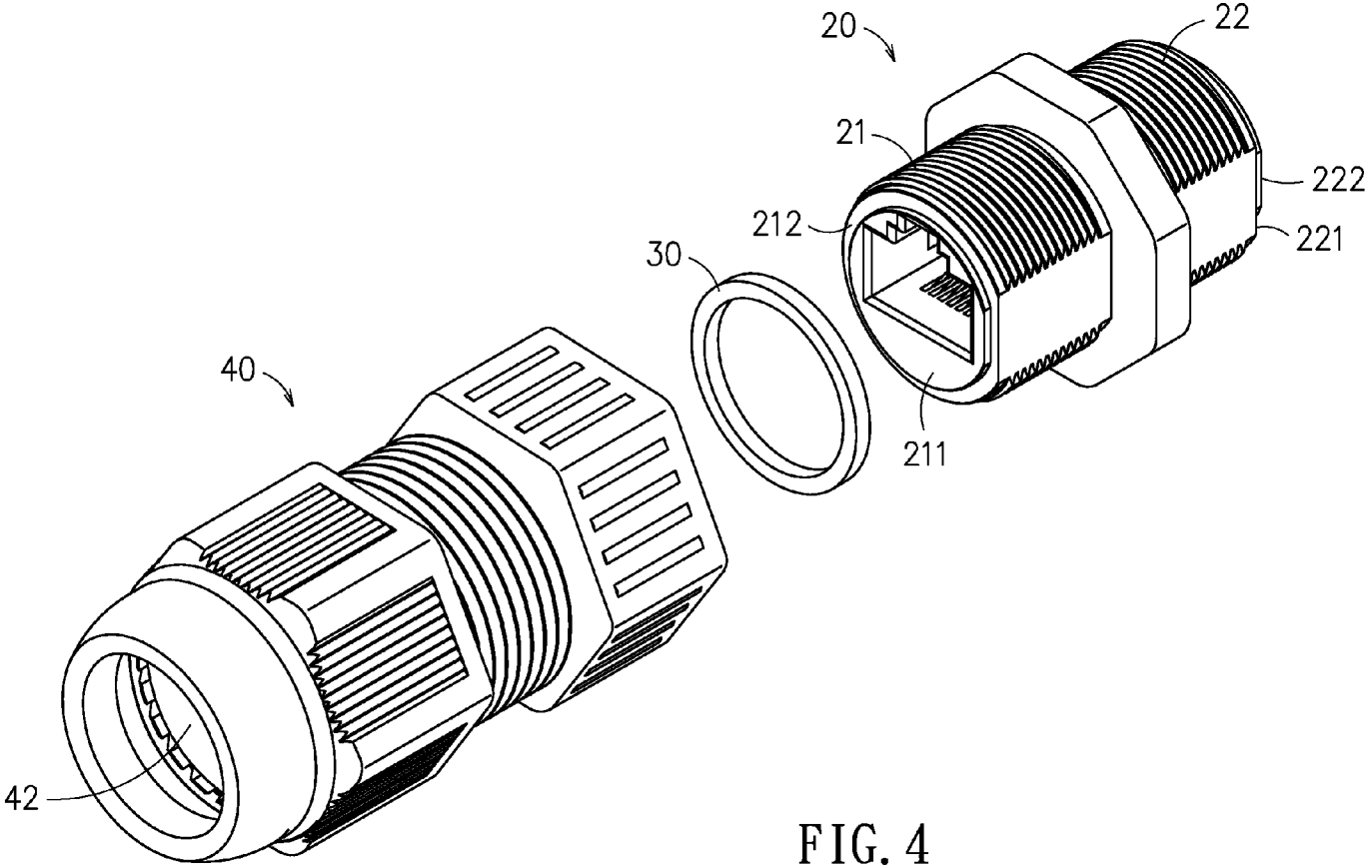
FIG. 4 is an exploded view of FIG. 3.
Figure 5:
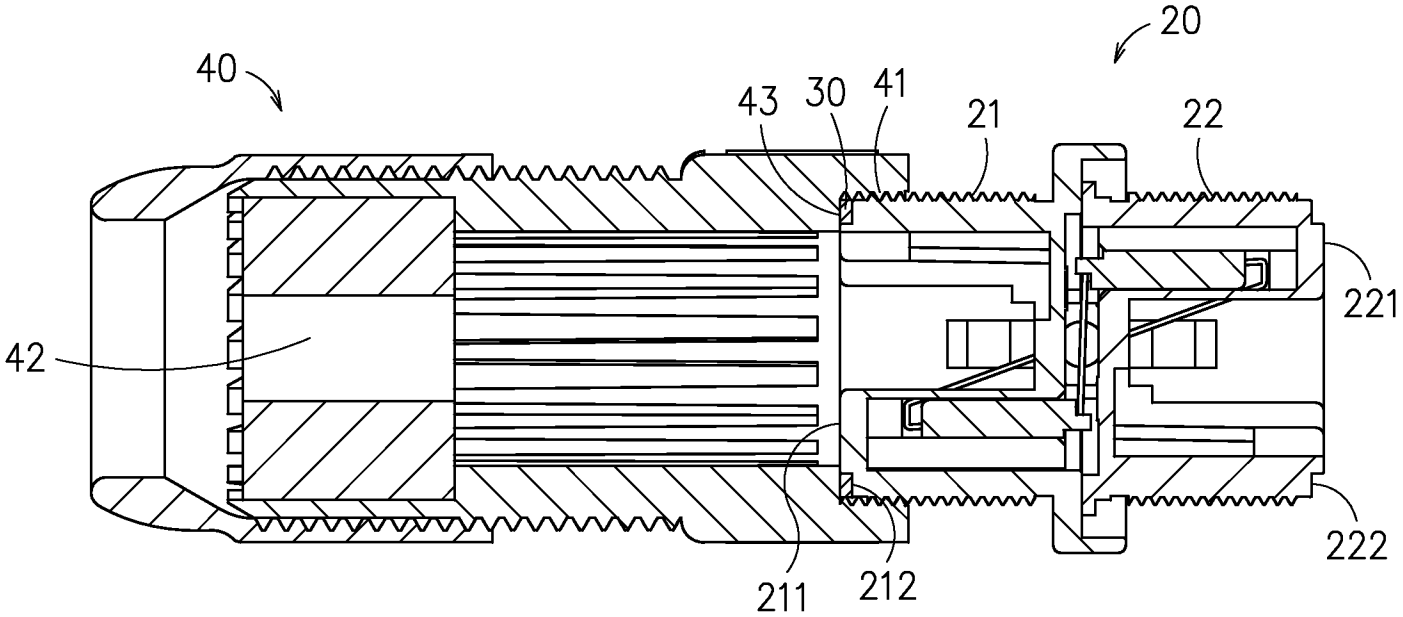
FIG. 5 is a cross sectional view of FIG. 3.
Figure 6:
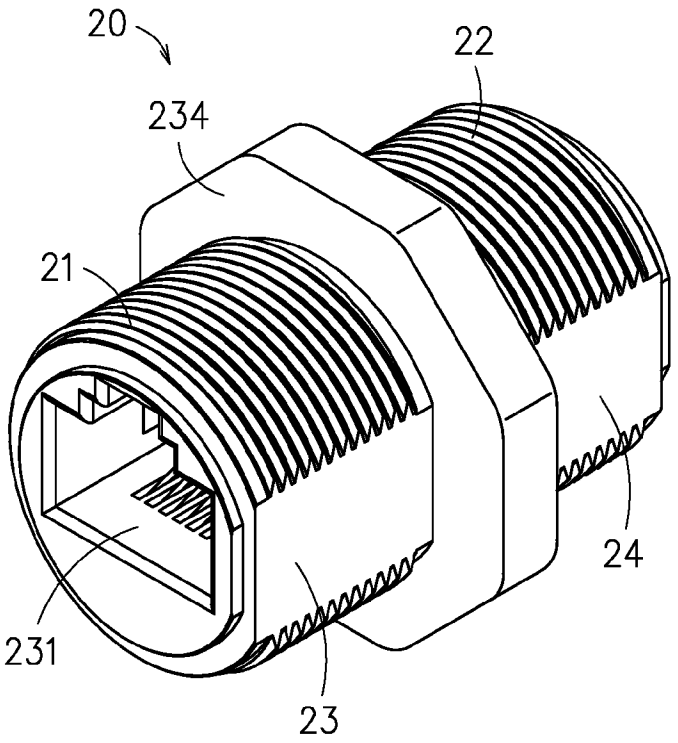
FIG. 6 is a three-dimensional view of a first frame used in a waterproof structure of communication connector according to an embodiment of the invention.
Figure 7:
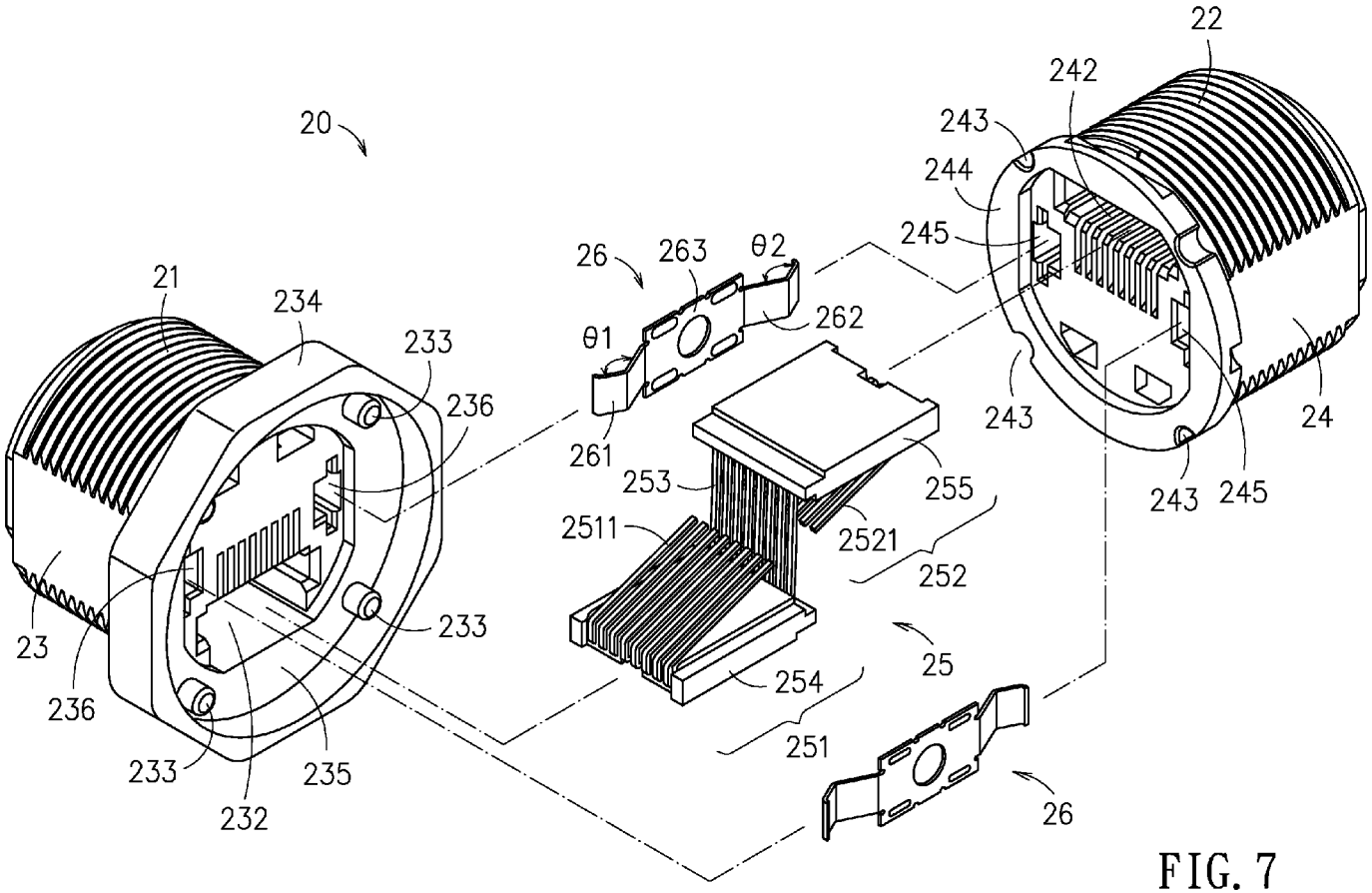
FIG. 7 is an exploded view of FIG. 6.

In the embodiment shown in FIG. 3 to FIG. 5, the waterproof structure of communication connector is composed of: a first frame 20, a first gasket 30 and a second frame 40. The first frame 20 is composed of a first connecting member 21 and a second connecting member 22 that are disposed opposite to each other, in which the first connecting member 21 is configured with a first end 211 in a manner that the first end 211 is formed with a first groove 212 surrounding the first end 211, and the second connecting member 22 is configured with a second end 221 in a manner that the second end 221 is formed with a second groove 222 surrounding the second end 221. In addition, the first gasket 30, being a ring-like structure made of a waterproofing material, such as rubber, is arranged receiving inside the first groove 212. Moreover, the second frame is configured with a third connecting member 41. In this embodiment, the first connecting member 21 is formed with an external thread, and the third connecting member 41 is formed with an internal thread, and the third connecting member 41 has an accommodation space 42 that is formed penetrating through the second frame 40 and is used for receiving a plug and the cable connecting to the plug, whereas the accommodation space 42 is further formed with a ring-like abutment surface 43. In this embodiment, the first connecting member 21 is arranged extending into the second frame 40, and by mating and screwing the external thread of the first connecting member 21 to the internal thread of the third connecting member 41, first connecting member 21 is connected to the third connecting member 41. Thereby, the first gasket 30 is tightly sandwiched between the first end 211 and the abutment surface 43 so as to waterproofing the assembling of the first frame 20 and the second frame 40 for preventing water and moisture from penetrating into first frame 20 and the second frame 40 via the screwing and mating of the first frame 20 and the second frame 40.

In the embodiment shown in FIG. 6 to FIG. 10, the first frame 20 is composed of a first shell 23, a second shell 24, a conductive element 25 and two ground pieces 26 that are arranged opposite to each other. The first shell 23, that is provided for the first connecting member 21 to be disposed thereat, is configured with a first socket 231 and a first slot 232 on two opposite surfaces of the first shell 23 while allowing the first socket 231 and the first slot 232 to formed in communication with each other. Similarly, the second shell 24, that is provided for the second connecting member 22 to be disposed thereat, is configured with a second socket 241 and a second slot 242 on two opposite surfaces of the second shell 24 while allowing the second socket 241 and the second slot 242 to formed in communication with each other. In addition, the surface of the first shell 23 where the first slot 232 has a plurality of protrusions 233 formed thereat, and the surface of the second shell 24 where the second slot 242 is disposed has a plurality of recesses 243 formed thereat. Moreover, the surface of the first shell 23 where the first slot 232 is disposed has a first flange 234 formed surrounding the surface while allowing the plural protrusions 233 to be disposed inside a first accommodation space 235 defined and enclosed by the surrounding of the first flange 234; and also the surface of the second shell 24 where the second slot 242 is disposed has a second flange 244 formed surrounding the surface while allowing the plural recesses 243, that are formed in a semicircle arc shape, to be disposed at the second flange 244. Furthermore, the first shell 23 is configured with two first penetration parts 236 that are arranged opposite to each other while allowing each first penetration part 236 to be formed penetrating through the first socket 231 and the surface of the first shell 23 where the first slot 232 is disposed; and similarly the second shell 24 is configured with two second penetration parts 245 that are arranged opposite to each other while allowing each second penetration part 245 to be formed penetrating through the second socket 241 and the surface of the second shell 24 where the second slot 242 is disposed; whereas the two first penetration parts 236 are arranged corresponding to the two penetration parts 245 in an one-by-one manner. It is noted that the first shell 23 and the second shell 24 can be made of plastics.

In this embodiment, the conductive element 25 is configured with a first conductive part 251, a second conductive part 252 and a connecting part 253 in a manner that the first conductive part 251 is composed of a plurality of first conductive terminals 2511, the second conductive part is composed of a plurality of second conductive terminals 2521, and the first conductive part 251 and the second conductive part 252 are disposed respective at two opposite ends of the connecting part 253 while allowing the first conductive part 251 and the second conductive part 252 to protrude respectively out of two opposite surfaces of the connecting part 253 for enabling the conductive element 25 to be formed as Z-shaped element. In addition, the first conductive part 251 is formed with a first mounting base 254; the second conductive part 252 is formed with a second mounting base 255; whereas the connecting part 253 is disposed at a position between the first mounting base 254 and the second mounting base 255 while allowing the plural first conductive terminals 2511 to extend out from an end of the first mounting base 254, and also allowing the plural second conductive terminals 2521 to extend out from an end of the second mounting base 255. Moreover, the first mounting base 254 and the second mounting base 255 can be made of plastics.

Moreover, each ground piece 26 has a fixing part 263, which is further configured with a first elastic terminal 261 and a second elastic terminal 262 at two opposite ends of the fixing part 263. The first elastic terminal 261 is substantially a bend plate with a first bent angle $\theta_1$, and similarly the second elastic terminal 262 is substantially a bend plate with a second bent angle $\theta_2$; and the first bend angle $\theta_1$ and the second bent angle $\theta_2$ are respectively an angle smaller than 180 degrees. It is noted that the ground pieces 26 can be made of metals.

Figure 9:
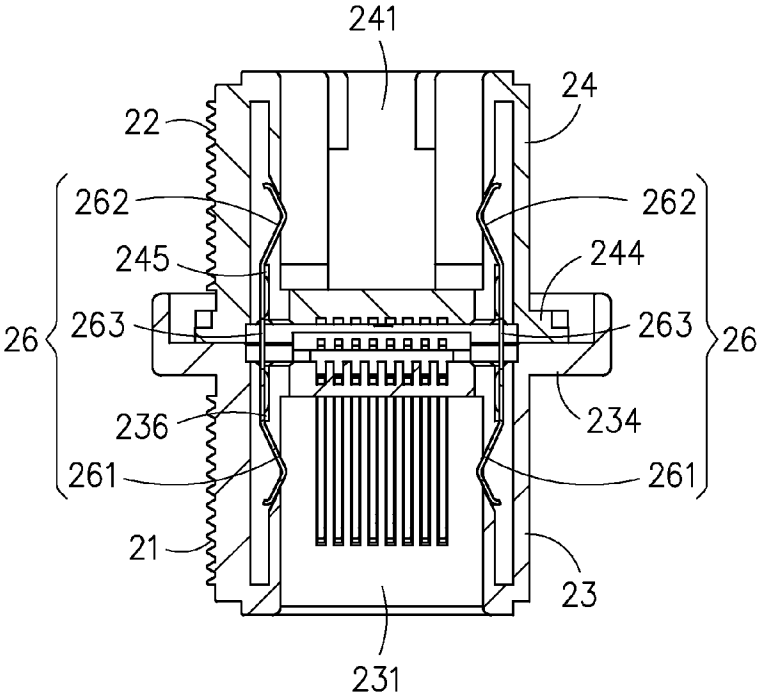
FIG. 9 is a B-B sectional view of FIG. 8.
Figure 8:
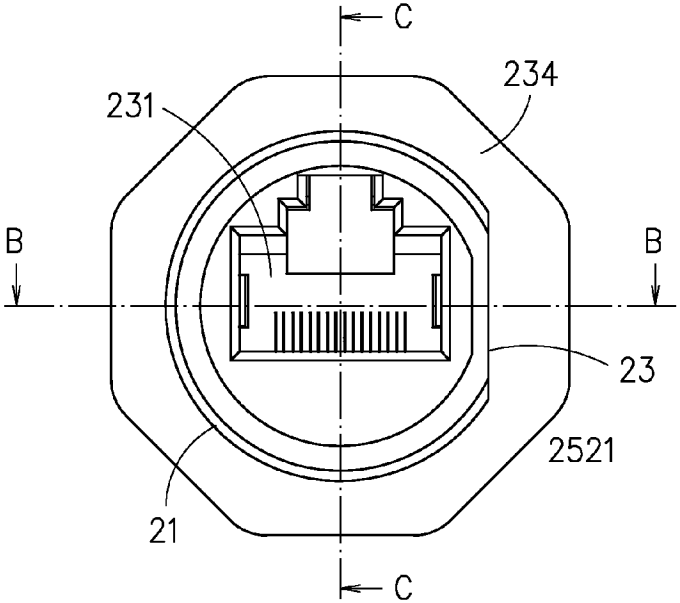
FIG. 8 is a front view of FIG. 6.
Figure 10:
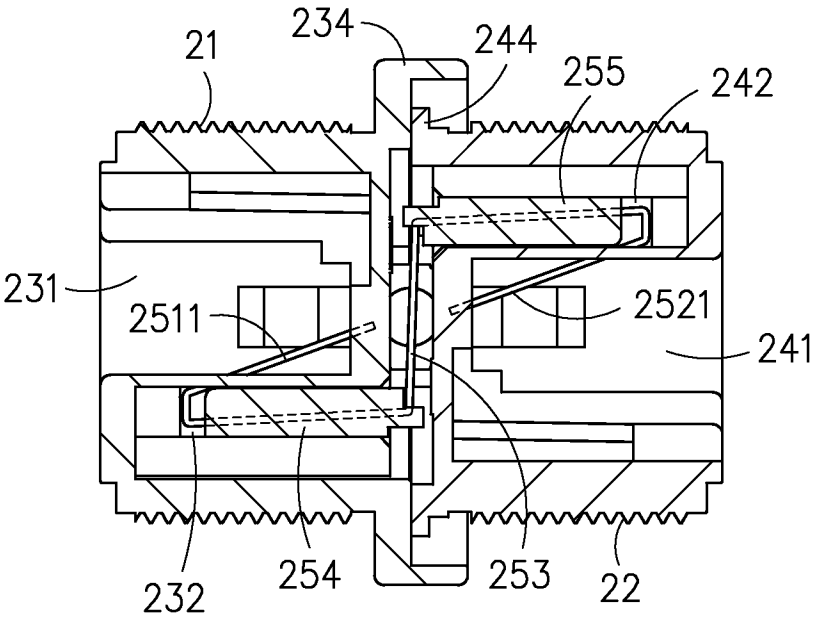
FIG. 10 is a C-C sectional view of FIG. 8.

In this embodiment, the surface of the first shell 23 where the first slot 232 is disposed is arranged coupling to the surface of the second shell 24 where the second slot 242 is disposed, while allowing the first mounting base 254 of the first conductive part 251 to insert into the first slot 231 and consequently enabling the plural first conductive terminals 2511 to extend into the first socket 231, and enabling the second mounting base 255 of the second conductive part 252 to insert into the second slot 242 and consequently enabling the plural second conductive terminals 2521 to extend into the second socket 241. Moreover, the two first penetration parts 236 are arranged corresponding to the two second penetration parts 245 in an one-by-one manner while allowing the fixing parts 263 of the two ground pieces 26 to be inserted respectively into the corresponding first and second penetration parts 236, 245, and thus enabling the first elastic terminal 261 to extend into the first socket 231, and simultaneously enabling the second elastic terminal 262 to extend into the second socket 241. In addition, the surface of the first elastic terminal 261 where the first bent angle $\theta_1$ is formed is arranged facing toward an inner sidewall of the first socket 231, while the surface of the second elastic terminal 262 where the second bent angle $\theta_2$ is formed is arranged facing toward an inner sidewall of the second socket 241. As shown in FIG. 9, there is a first elastic deformation space formed between the first elastic terminal 261 and an inner sidewall of the first socket 231; and there is a second elastic deformation space formed between the second elastic terminal 262 and an inner sidewall of the second socket 241. When there is a plug plugged into either the first socket 231 or the second socket 241, the plug will be clamped by an elastic force provided by the two opposite first elastic terminals 261 or the two opposite second elastic terminal 262. In addition, the protrusions 233 are arranged corresponding to the recesses 243 in an one-by-one manner for allowing the protrusions 233 to inset into their corresponding recesses 243, and the second flange 244 is disposed inside the first accommodation space 235.

From the above description, it is noted that the first frame 20 is featured in that: the first socket 231 and the second socket 241 that are disposed opposite to each other at two opposite end of the first frame 20 are respectively provided for a plug to plug in, whereas the plug inside the first socket 231 is orientated in a direction opposite to the plug inside the second socket 241.

Figure 11:
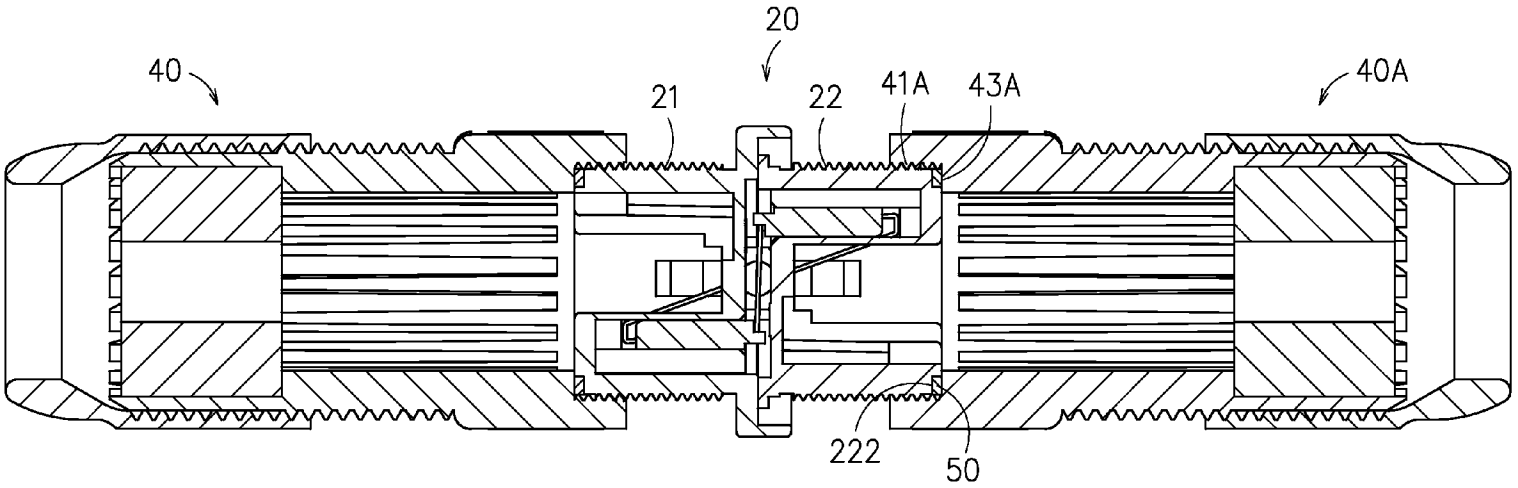
FIG. 11 is a cross section view of an addition second frame that is provided to connect to the exemplary communication connector shown in FIG. 3.

Please refer to FIG. 11, which is a cross section view of an addition second frame that is provided to connect to the exemplary communication connector shown in FIG. 3. As shown in FIG. 11, as the first frame of the present invention is designed with two-way connection ability, the first connecting member 21 and the second connecting member 22 are connected respectively to a second frame 40, 40A, whereas there is a second gasket 50 being disposed in a second groove 22, and similarly, the second gasket 50 is made of a waterproofing material, such as rubber. Thereby, the second connecting member 22 is arranged extending into the second frame 40A for connecting to the third connecting member 41A, and also the second gasket 50 is sandwiched between the second end 221 and the abutment surface 43A of the second frame 40A.

Figure 12:
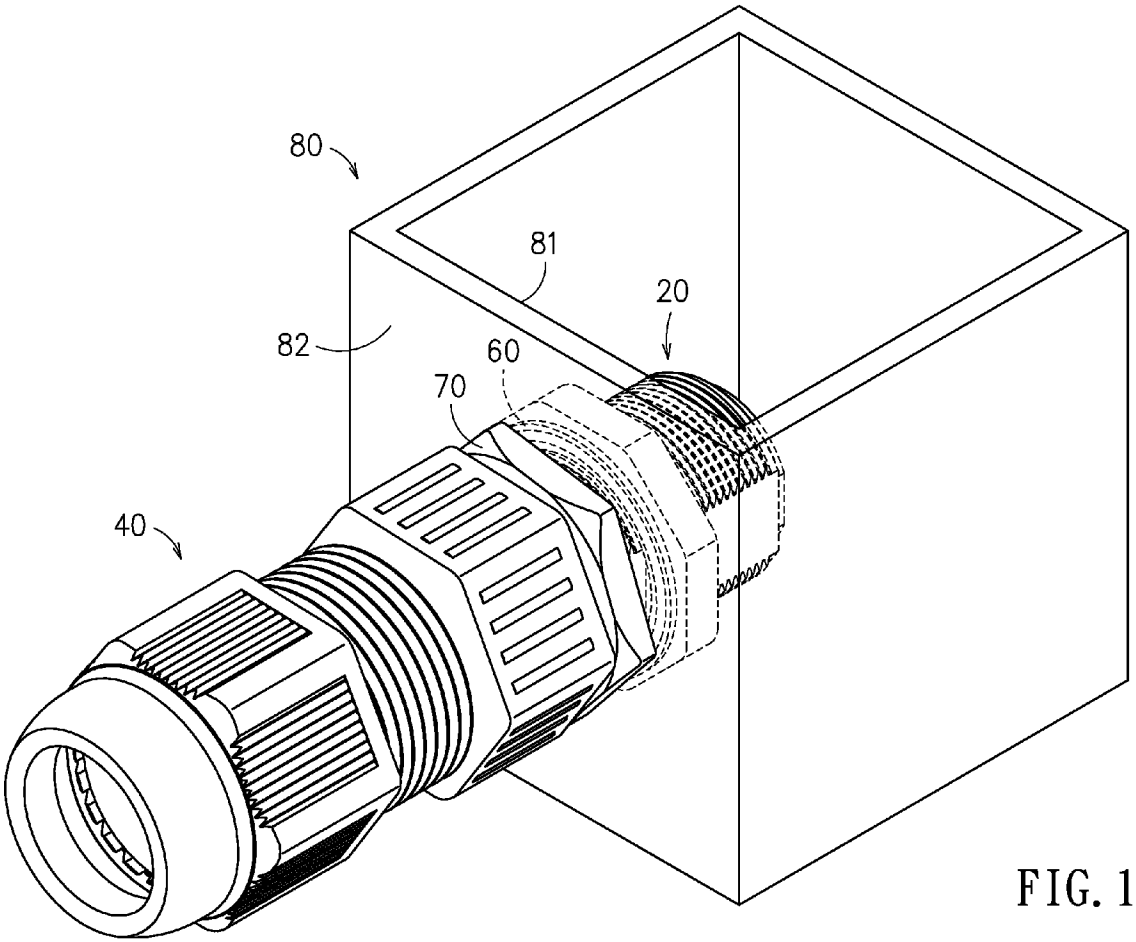
FIG. 12 is a three-dimensional diagram showing the exemplary communication connector shown in FIG. 3 that is being received inside a shell.
Figure 13:
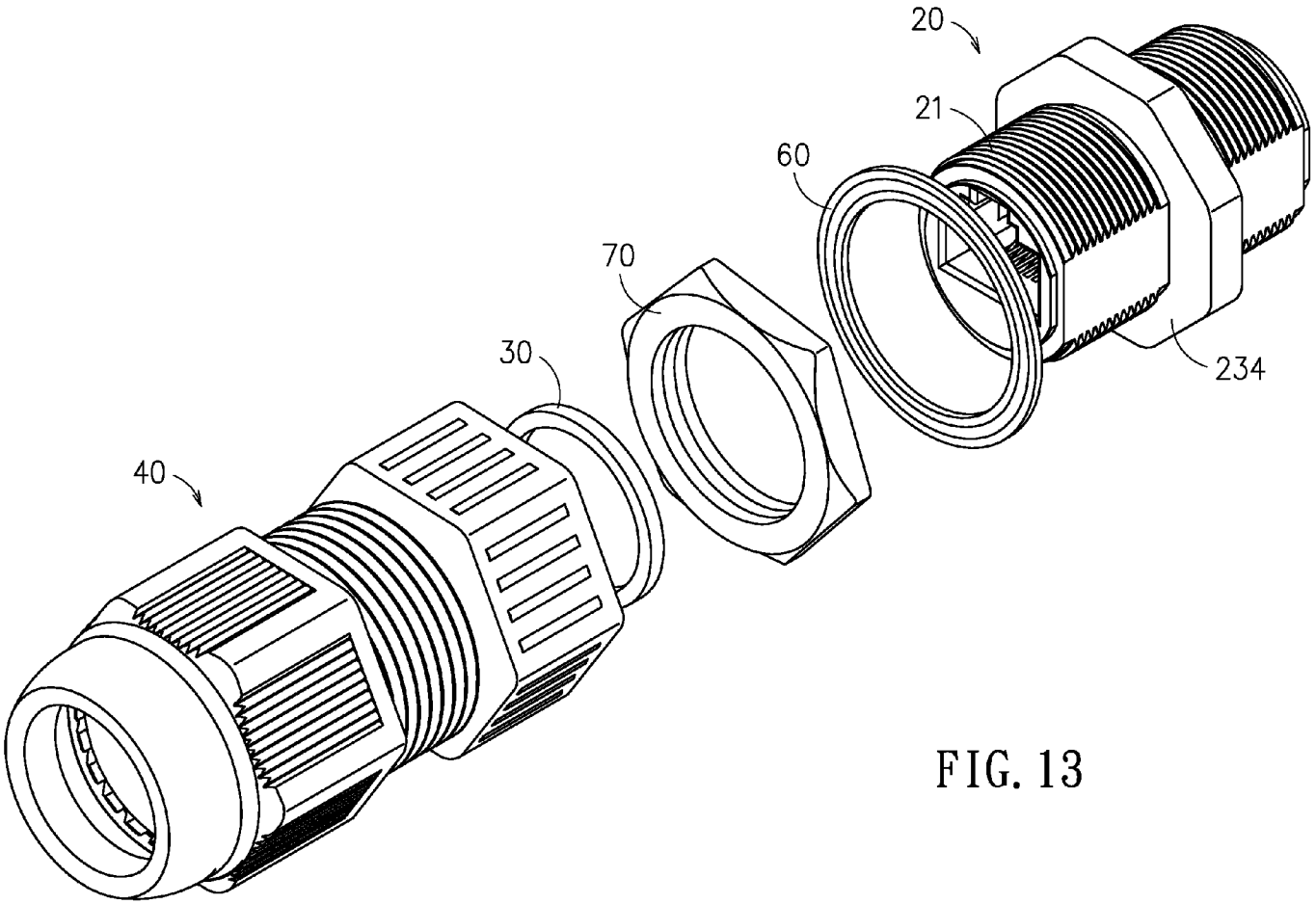
FIG. 13 is an exploded diagram showing the exemplary communication connector shown in FIG. 3 without the shell.
Figure 14:
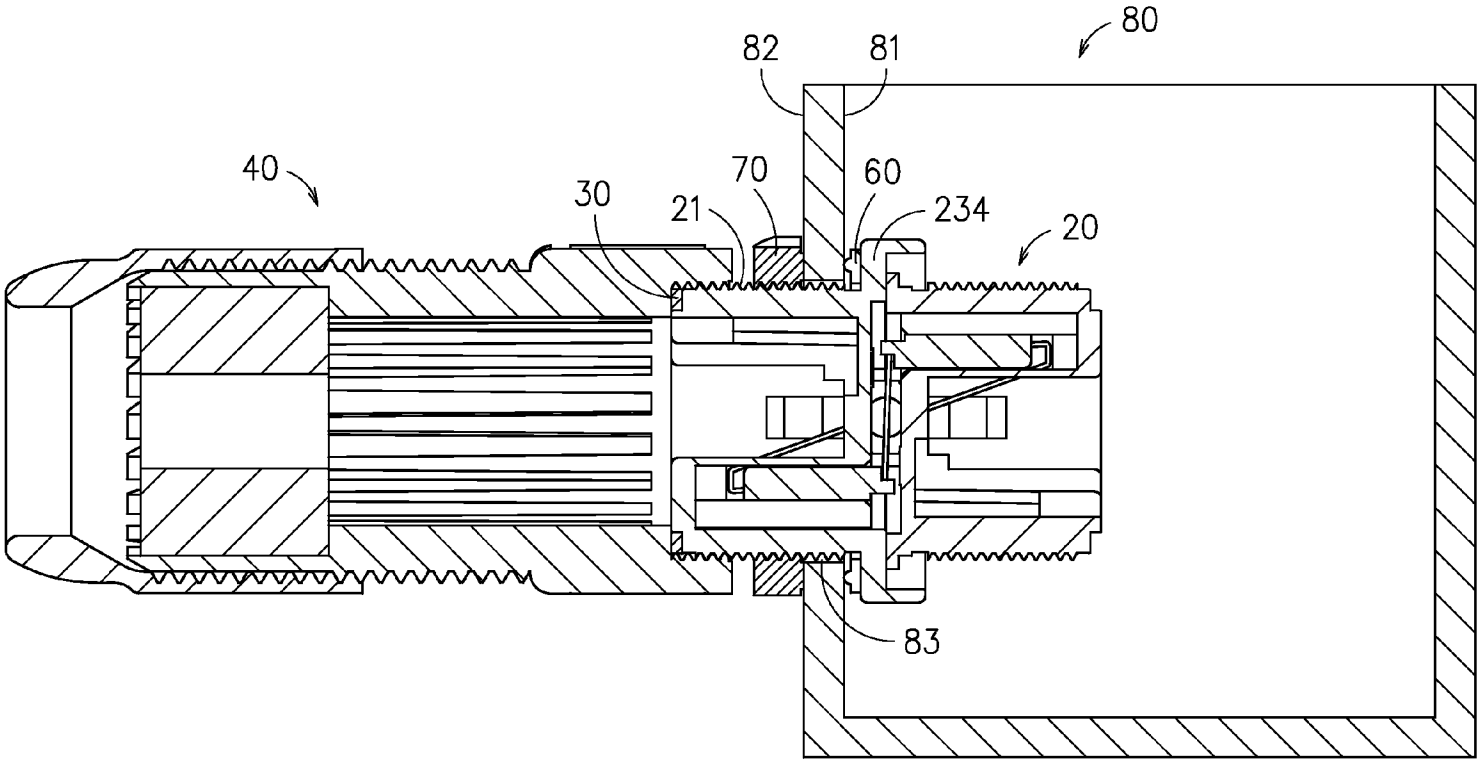
FIG. 14 is a cross sectional view of FIG. 12.

In an embodiment shown in FIG. 12 to FIG. 14, the waterproof structure of communication connector is composed of: a first frame 20, a first gasket 30, a second frame 40, a third gasket 60 and a nut 70. Similarly, the third gasket is made of a waterproofing material, such as rubber. In addition, the nut 70 and the third gasket 60 are arranged mounting on the first connecting member 21 of the first frame 20 while allowing the nut 70 to be disposed at a position between the third gasket 60 and the second frame 40, enabling the first frame 20 and the second frame 40 to be disposed respectively on an inner side 81 and an out side 82 of a third shell 80, enabling the first connecting member 21 to be arranged piecing through a hole 83 formed on the third shell 80, enabling the third gasket 60 to be disposed at a position between the inner side 81 and the first flange 234 of the first frame 20, enabling the nut 70 to mate and screw to the first connecting member 21 so as to force the third shell 80 and the third gasket 60 to be sandwiched tightly between the inner side 81 and the first flange 234.

To sum up, the present invention provides a waterproof structure of communication connector that not only is simple in structure, effective in waterproofing and small in size, but also is a convenient device with two-way connecting first frame.

With respect to the above description then, it is to be realized that the optimum dimensional relationships for the members of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A waterproof structure of communication connector, comprising:

a first frame, composed of a first connecting member and a second connecting member that are disposed opposite to each other, in which the first connecting member is configured with a first end in a manner that the first end is formed with a first groove surrounding the first end;

a first gasket, made of a waterproofing material while being disposed receiving inside the first groove; and at least one second frame, each having a third connecting member that is formed with an accommodation space, while the accommodation space is further formed with an abutment surface; wherein, the first connecting member is arranged extending into the accommodation space of the second frame for connecting to the third connecting member, while enabling the first gasket to be sandwiched between the first end and the abutment surface; wherein the first frame further comprises:

a first shell, provided for the first connecting member to be disposed thereat, configured with a first socket and a first slot on two opposite surfaces of the first shell while allowing the first socket and the first slot to formed in communication with each other;

a second shell, provided for the second connecting member to be disposed thereat, configured with a second socket and a second slot on two opposite surfaces of the second shell while allowing the second socket and the second slot to formed in communication with each other; and a conductive element, configured with a first conductive part, a second conductive part and a connecting part in a manner that the first conductive part is composed of a plurality of first conductive terminals, the second conductive part is composed of a plurality of second conductive terminals, and the first conductive part and the second conductive part are disposed respective at two opposite ends of the connecting part while allowing the first conductive part and the second conductive part to protrude respectively out of two opposite surfaces of the connecting part;

thereby, the surface of the first shell where the first slot is disposed is arranged coupling to the surface of the second shell where the second slot is disposed, while allowing the first conductive part to insert into the first slot and consequently enabling the plural first conductive terminals to extend into the first socket, and enabling the second conductive part to insert into the second slot and consequently enabling the plural second conductive terminals to extend into the second socket.

2. The waterproof structure of communication connector of claim 1, having a plurality of the second frames being arranged in a manner that one of the plural second frames is connected to the first connecting member while allowing another one of the plural second frames to connect to the second connecting member; and the second connecting member is further configured with a second end in a manner that the second end is formed with a second groove surrounding the second end while allowing a second gasket, that is made of a waterproofing material, to be fit into the second groove, and enabling the second connecting member to be arranged extending into further another one of the plural second frames for connecting to the third connecting member, and also enabling the second gasket to be sandwiched between the second end and the abutment surface.

3. The waterproof structure of communication connector of claim 1, wherein the surface of the first shell where the first slot is disposed has a plurality of protrusions formed thereat; the surface of the second shell where the second slot is disposed has a plurality of recesses formed thereat; and the plural protrusions are arranged at positions corresponding to the plural recesses in an one-by-one manner.

4. The waterproof structure of communication connector of claim 1, wherein the first conductive part is formed with a first mounting base; the second conductive part is formed with a second mounting base; the connecting part is disposed at a position between the first mounting base and the second mounting base while allowing the plural first conductive terminals to extend out from an end of the first mounting base, and allowing the plural second conductive terminals to extend out from an end of the second mounting base; the first mounting base is fitted into the first slot while allowing the plural first conductive terminals to extend into the first socket, and similarly, the second mounting base is fitted into the second slot while allowing the plural second conductive terminals to extend into the second socket.

5. The waterproof structure of communication connector of claim 1, further comprising:

two ground pieces, arranged respectively at position corresponding to each other, each ground piece being configured with a first elastic terminal and a second elastic terminal at positions opposite to each other while allowing the first elastic terminal to be disposed inside the first socket and the second elastic terminal to be disposed inside the second socket;

wherein, there is a first elastic deformation space formed between the first elastic terminal and an inner sidewall of the first socket; and there is a second elastic deformation space formed between the second elastic terminal and an inner sidewall of the second socket.

6. The waterproof structure of communication connector of claim 5, wherein each ground piece has a fixing part, while allowing the first elastic terminal and the second elastic terminal to be arranged at two opposite ends of the fixing part; the first shell is configured with two first penetration parts that are arranged opposite to each other while allowing each first penetration part to be formed penetrating through the first socket and the surface of the first shell where the first slot is disposed; the second shell is configured with two second penetration parts that are arranged opposite to each other while allowing each second penetration part to be formed penetrating through the second socket and the surface of the second shell where the second slot is disposed; the two first penetration parts are arranged corresponding to the two second penetration parts in an one-by-one manner while allowing the two ground pieces to be inserted respectively into the corresponding first and second penetration parts, and thus enabling the first elastic terminal to extend into the first socket, and enabling the second elastic terminal to extend into the second socket.

7. The waterproof structure of communication connector of claim 5, wherein the first elastic terminal is substantially a bend plate with a first bent angle, and the second elastic terminal is substantially a bend plate with a second bent angle; and the first bend angle and the second bent angle are respectively an angle smaller than 180 degrees; the surface of the first elastic terminal where the first bent angle is formed is arranged facing toward an inner sidewall of the first socket, while the surface of the second elastic terminal where the second bent angle is formed is arranged facing toward an inner sidewall of the second socket.

8. The waterproof structure of communication connector of claim 1, wherein the surface of the first shell where the first slot is disposed has a first flange formed surrounding the surface while allowing the plural protrusions to be disposed inside a first accommodation space defined and enclosed by the surrounding of the first flange; the surface of the second shell where the second slot is disposed has a second flange formed surrounding the surface while allowing the plural recesses, that are formed in a semicircle arc shape, to be disposed at the second flange, and also enabling the second flange to be disposed inside the first accommodation space.

9. The waterproof structure of communication connector of claim 8, wherein the first connecting member is formed with an external thread, and the third connecting member is formed with an internal thread, thereby, by mating and screwing the external thread to the internal thread, first connecting member is connected to the third connecting member.

10. The waterproof structure of communication connector of claim 9, further comprising:

a nut; and a third gasket, made of a waterproofing material;

wherein, the nut and the third gasket are arranged mounting on the first connecting member while allowing the nut to be disposed at a position between the third gasket and the second frame, enabling the first frame and the second frame to be disposed respectively on an inner side and an out side of a third shell, enabling the first connecting member to be arranged piecing through a hole formed on the third shell, enabling the third gasket to be disposed at a position between the inner side and the first flange, enabling the nut to mate and screw to the first connecting member so as to force the third shell and the third gasket to be sandwiched tightly between the inner side and the first flange.

* * * * *